US005533624A

United States Patent [19]

Söderholm et al.

[11] Patent Number: 5,533,624

[45] Date of Patent: Jul. 9, 1996

[54] PACKAGING BAG, PREFERABLY FOR PERILOUS SAMPLES, AND METHOD FOR PRODUCING THE PACKAGING BAG

[76] Inventors: Jan Söderholm, Luntmakargatan 71, S-113 51 Stockholm; Hugo Cedraeus, Grönviksvägen 187, S-161 42 Bromma, both of Sweden

[21] Appl. No.: 204,279

[22] PCT Filed: Sep. 2, 1992

[86] PCT No.: PCT/SE92/00605

§ 371 Date: Mar. 7, 1994

§ 102(e) Date: Mar. 7, 1994

[87] PCT Pub. No.: WO93/04946

PCT Pub. Date: Mar. 18, 1993

[30] Foreign Application Priority Data

Sep. 6, 1991 [SE] Sweden ..... 9102569

[51] Int. Cl.[6] ..... B65D 85/00

[52] U.S. Cl. ..... 206/524.3; 206/524.5; 383/38; 383/86; 493/264

[58] Field of Search ..... 206/232, 569, 206/521, 524.4, 524.5, 524.3; 383/38, 39, 40, 84, 86; 493/264, 276, 287, 326, 331, 340

[56] References Cited

U.S. PATENT DOCUMENTS

| | | | |
|---|---|---|---|
| 3,266,712 | 8/1986 | McCleneghan | 229/72 |
| 4,263,080 | 4/1981 | Whiting, Jr. | 206/524.5 X |
| 4,744,673 | 5/1988 | Nakamura | 383/38 |
| 4,872,553 | 10/1989 | Suzuki et al. | 206/524.4 |

FOREIGN PATENT DOCUMENTS

| | | |
|---|---|---|
| 0378861 | 7/1990 | European Pat. Off. . |
| 444555 | 4/1986 | Sweden . |
| 468913 | 4/1969 | Switzerland . |
| 2081215 | 2/1982 | United Kingdom . |

*Primary Examiner*—Jacob K. Ackun
*Attorney, Agent, or Firm*—Shapiro and Shapiro

[57] ABSTRACT

A package, such as for perilous samples, comprises a compartmented package body having first and second layers disposed, respectively, to opposite sides of an intermediate layer, with a first compartment disposed between the first and intermediate layers and a second compartment disposed between the second and intermediate layers. Each compartment has an opening and an associated adhesive sealing flap for sealing the opening. The openings, with the associated sealing flaps, are disposed at opposite ends of the package body. The sealing flaps are provided with removable tear strips for opening the corresponding compartments. A preferred method for producing the package utilizes three sheet materials corresponding to the layers of the package body. Portions corresponding to the flaps are provided at opposite edges of the sheet material corresponding to the second layer. The portions are slotted and material of the tear strips is attached to cover the slots on one side. The other side of the portions is provided with pressure-sensitive adhesive covered with a removable protective material. The sheet materials are placed side-by-side and bonded to form the compartments and openings.

48 Claims, 4 Drawing Sheets

Figure 1:
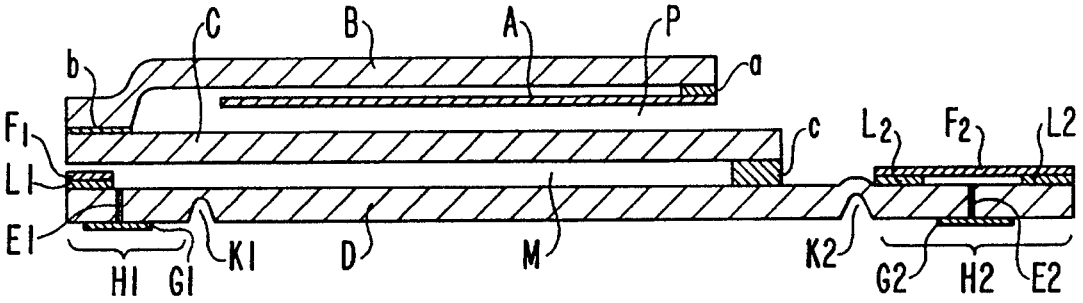

PACKAGING BAG, PREFERABLY FOR PERILOUS SAMPLES, AND METHOD FOR PRODUCING THE PACKAGING BAG

The present invention relates to a package, preferably for perilous samples and the like, and a method for producing the package.

Swedish Patent 8304910-6 discloses a package intended primarily for perilous samples. This package comprises an inner compartment for perilous samples or the like, and an outer compartment surrounding the inner compartment and intended for some kind of document, such as a packing slip. The outer compartment has a slot-shaped opening next to the opening of the inner compartment. Both compartments can be closed by means of one and the same flap, sealing the inner compartment in a liquid-tight manner. The outer compartment can be opened by means of a tear thread, leaving the inner compartment sealed.

Packages of this type serve their purpose fairly well, but are not cheap enough to allow low-cost mass production. Further, they involve a certain risk of confusion, i.e. that the perilous sample is placed in the wrong compartment. There is also the admittedly small risk that an externally besmeared sample may, when put in the right compartment, come into contact also with that part of the flap which is intended to seal the other or second compartment, i.e. the document compartment, in which case there is a risk of infection when opening this compartment.

The present invention aims at obviating the risk of the first compartment thus infecting the second compartment when the sample is leaking or exteriorly besmeared, especially when opening the second compartment. Further, the invention provides a method for producing such a package, enabling simple and low-cost mass production as well as reducing the risk of the sample compartment being confused with the document compartment.

According to the invention, this is achieved by a package and method as set forth in the appended claims.

The provision of the first and the second flap, and consequently of the openings of the two compartments, on opposite ends of the package effectively obviates the risk of infection when an exteriorly besmeared sample is put in the first compartment and the compartments are sealed, or in the case of a leaking sample, when the second compartment is later opened. In a further development of the invention, the first flap is located, when not in use, outside the two compartments of the package, and so this flap and the associated compartment are naturally perceived by the user as intended primarily for the perilous sample.

This effect is further enhanced if, as in one embodiment of the invention, the contour of the second flap essentially coincides with the adjoining contour of the package, such that the second flap is not perceived as a sealing flap until the first flap has been applied and only the second flap remains open. This further reduces the risk of the sample being put in the wrong compartment.

The flaps are preferably each provided with pressure-sensitive adhesive covered by a removable protective layer. Also, the flaps are preferably each formed with a slot extending therethrough and externally covered by a strip to be torn off for opening the associated compartment. This ensures, in a manner known per se, that the pressure-sensitive adhesive will seal the associated compartment only when intended to, as well as facilitates subsequent opening of the compartments.

The layer of pressure-sensitive adhesive on the first flap preferably surrounds the entire associated slot with a certain spacing, whereby the slot or the surrounding adhesive layer will have to be accurately positioned in relation to the opening of the compartment, this rendering production more simple and less expensive while enabling liquid-tight closure of the compartment and simplified handling.

The pressure-sensitive-adhesive layer on the second flap preferably flanks, with a certain spacing, the associated slot in the second flap closest to its outer terminal edge. This also renders less expensive and simplifies production without adversely affecting the handleability of the package. Also, it confers the additional advantage of reducing the risk that documents which may not have been pushed far enough into the second compartment will inadvertently get stuck when the second flap with the adhesive layer is applied over the opening to the document compartment.

The external side of the first compartment sealable by means of the first flap may comprise or consist of a shock-absorbing material. In this case, one side of the second compartment sealable by means of the second flap may conveniently also comprise or consist of a shock-absorbing material. Alternatively, the internal side of the first compartment sealable by means of the first flap may comprise or consist of a shock-absorbing material.

In one embodiment, a liquid absorber is provided in the first compartment sealable by means of the first flap. The absorber may be in the form of a sheet which is placed between the shock-absorbing layers and attached along one short edge to the inside of the outer, optionally shock-absorbing layer, close to the opening of the sample compartment, thereby rendering it impossible to place the sample between the absorber and the outer layer. Conveniently, the absorber is opaque to make it impossible to read text or the like on the sample. Further, the liquid-absorbing layer suitably looks different when dry than when wet or moist, and the outside of the first compartment suitably is transparent, translucent, or otherwise translucid to make it possible to observe from outside the appearance of the liquid-absorbing layer and thus alterations caused by a leaking sample.

In another preferred embodiment, the internal and/or the external side of the second compartment sealable by means of the second flap is made of an opaque material. This is to prevent unauthorised persons from reading or otherwise optically perceiving, without opening the package, messages, documents or the like placed in the second compartment. If a package according to the invention has once been opened, this can be seen from outside.

The method according to the invention confers the advantage that the package can be mass-produced at a low cost and in a simple manner with high machine time utilisation and high availability. Certain broad tolerances as to material and positioning may thus be adopted, and accuracy is only required in some final operations, which renders less expensive and simplifies production and results in a product having a competitive price. The method can be conducted as a continuous process, wherein preferably a paper web and a shock-absorbing materials are unwound from rolls and are all, with one of their longitudinal sides, adjusted into edge-to-edge relationship, which is a fairly simple operation, and the roll width of, inter alia, the first shock-absorbing-material web is chosen so as to be about a flap width narrower than that of the paper web, but wider than the roll width of the second shock-absorbing-material web.

Conveniently, also the liquid-absorbing material may delivered in rolls which are narrower than the package, and may be cross-cut slightly shorter than the width of the shortest shock-absorbing material, such that also this material can be supplied continuously. The cut liquid-absorbing sheets are preferably attached by or adjacent to one cut edge, either directly at or adjacent to the closest edge of the second shock-absorbing material.

Also the tear strips may be supplied from rolls and when applied over the slots be provided with adhesive, excepting the tear-strip ends, thereby to produce gripping flaps at the ends so that the tear strips can be easily torn off.

Preferably, use is made of opaque paper, such as kraft paper, kraft liner or the like, providing strength as well as shutting off the document or referral compartment from view. The paper web may suitably have printed on it opening directions, flap and compartment designations, mailing address pre-print and/or current information with pattern repeat corresponding to the length or width of the package.

The shock-absorbing material used conveniently may consists of two plastic sheetings welded together and enclosing gas or air cushions. Alternatively, use can be made of two plastic sheetings with a third, intermediate plastic sheeting forming the air cushions. The plastic sheetings of the layers to be welded together with the liquid-absorbing material are suitably translucent. The shock-absorbing material provided between the paper layer and the liquid-absorbing material need not be translucent but may of course be so. One reason for choosing translucent plastic sheetings is that they are as a rule less expensive and available as standard articles, rendering production and the final product less expensive.

Figure 3:
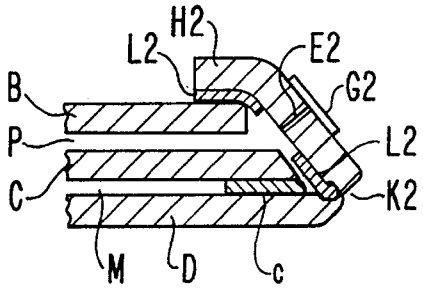
Figure 4:
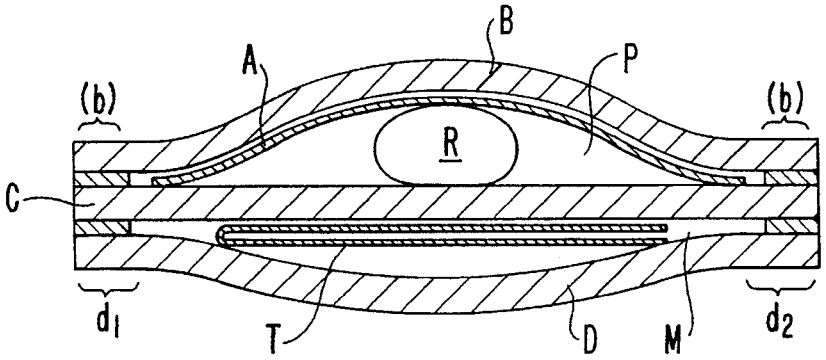
Figure 5:
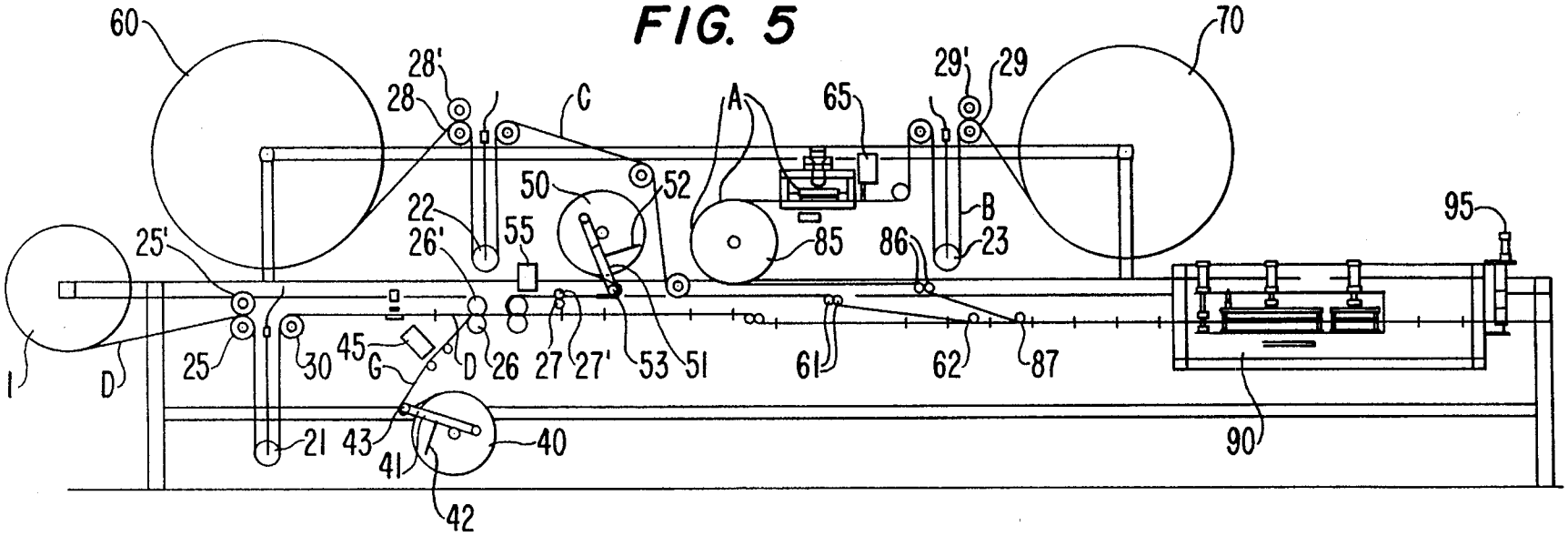
Figure 6:
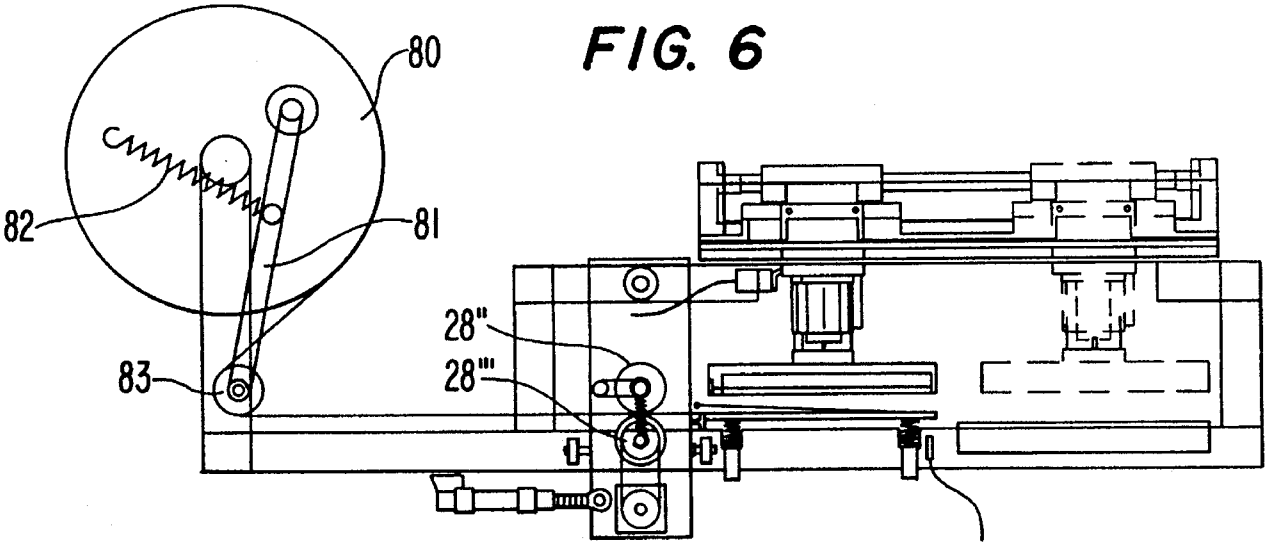
Figure 7:
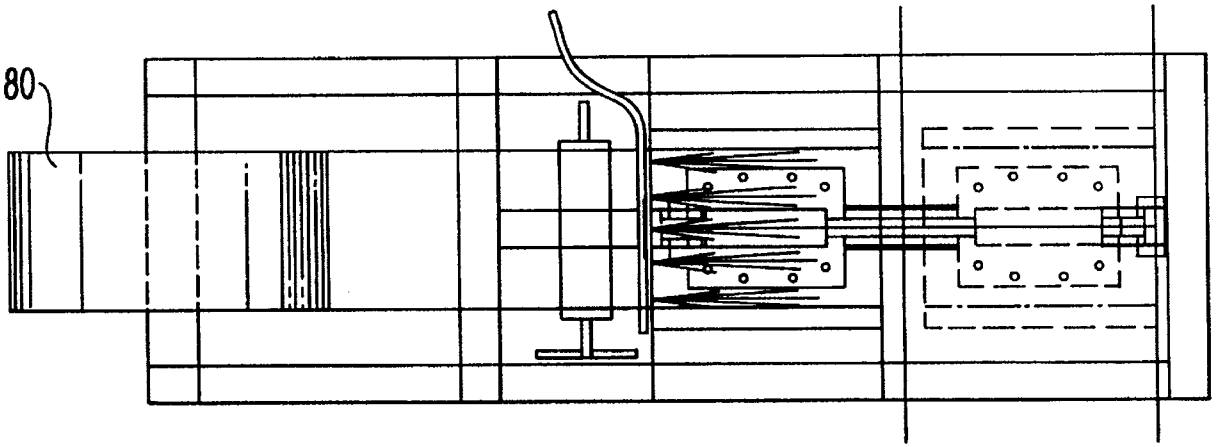
Figure 8:
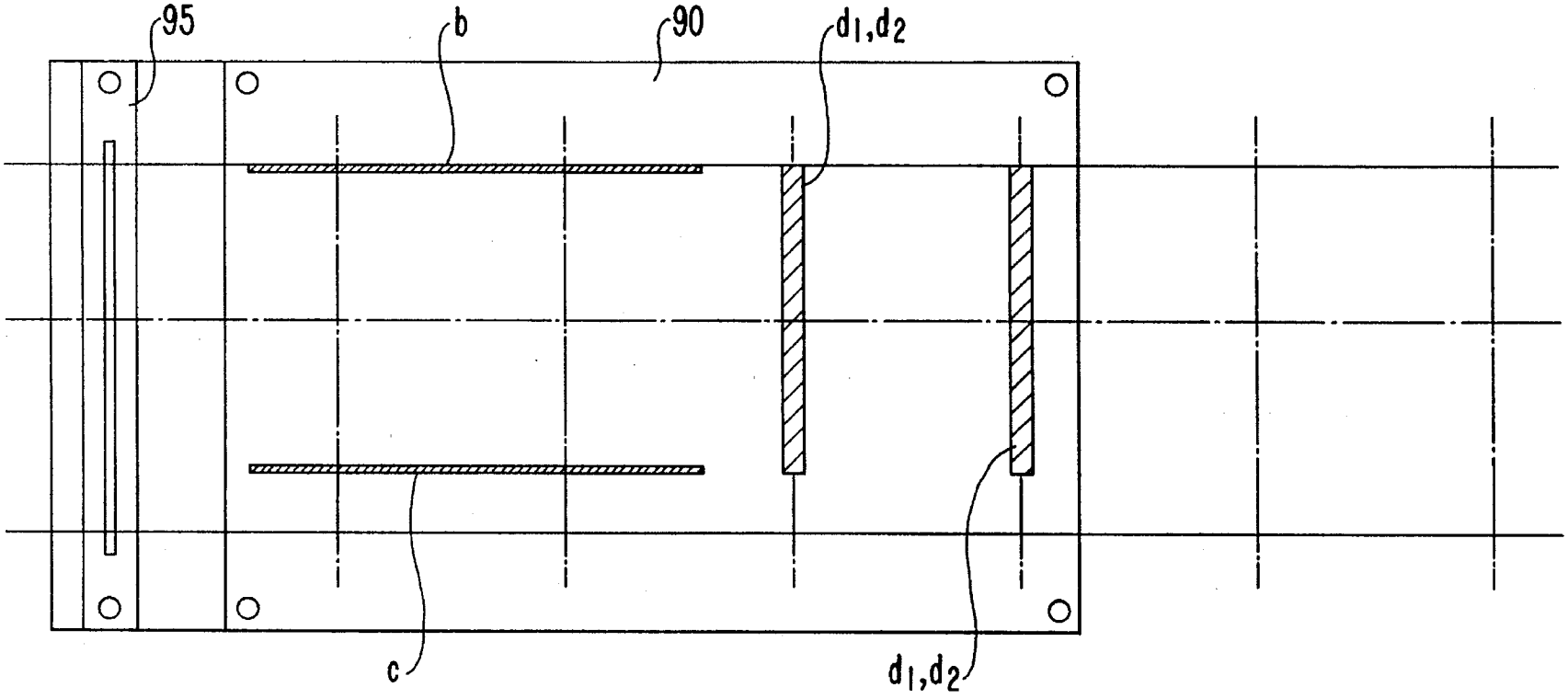

The invention will now be described in more detail with reference to the accompanying drawings illustrating an embodiment of a package according to the invention and an embodiment of a system for implementing the method of production according to the invention. In the drawings, FIG. 1 is a schematic section of an embodiment of a package according to the invention, FIG. 2 is a plan view towards the sealing flap of the sample compartment, FIG. 3 is a section of the right-hand end portion (in FIG. 1) of the package when sealed, FIG. 4 is a cross-section of an alternative embodiment of the package, FIG. 5 is a schematic side view of a system for implementing the inventive method for producing the package according to the invention, FIG. 6 is a view illustrating a portion of the system for the cutting and the supply of the liquid-absorbing material, FIG. 7 is a top view of the arrangement in FIG. 6, and FIG. 8 is an enlarged plan view showing an impulse-welding station to the right in FIG. 5.

The embodiment of the package according to the invention as schematically illustrated in cross-section in FIG. 1 comprises a first compartment P adapted to contain a sample and sealable by means of a first flap H2, as well as a second compartment M adapted to contain documents or referrals and sealable by means of a second flap H1. As is evident from FIG. 1, the first flap H2 and the second flap H1, as well as the opening of the first compartment P and the opening of the second comparment M, are provided on opposite ends of the package. In the first compartment P, sealable by means of the first flap H2, there is provided a liquid absorber A. At its right-hand terminal edge, the liquid absorber is attached adjacent to the opening of the compartment P. A sample R placed in the compartment P (see FIG. 4) is thus not visible, and the opacity of the absorber A further makes it impossible to read anything that may be written or printed on the sample.

Figure 2:
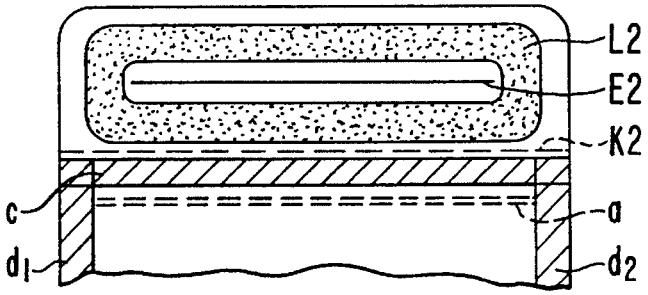

As appears from FIGS. 1 and 2, the flap H2 adapted to seal the sample compartment P is situated outside the two compartments of the package when not in use. That is, it protrudes beyond respective ends of the compartments at one end of the package. The flap H1 of the referral or document compartment, on the other hand, has a contour which substantially coincides with the adjoining contour of the package.

The two flaps H1 and H2 have respective layers of pressure-sensitive adhesive L1 and L2 covered by corresponding strippable protective or release layers F1, F2. Preferably, these protective layers consist of silicone-treated sheeting material, such as silicone-treated paper. Further, each flap has a slot E1 or E2 extending through it and externally (i.e. on the downward side in FIG. 1) covered by a removable strip G1 or G2 for opening the associated compartment. Each of the slots E1 and E2 is shorter than the associated flap in the longitudinal direction of the slot each, as appears from FIG. 2 (slot E2). The pressure-sensitive-adhesive layer L2 surrounds the slot E2 at a distance, while the adhesive layer L1 is only flanking the slot E1 closest to the outer long side of the flap. The strips G1 and G2 covering the slots E1 and E2 are but slightly longer than the associated slot, and are covered by adhesive layers, while one or both ends of the strips are left without adhesive to form gripping flaps, making it easy to remove the tear strips from an optional side.

The upper boundary wall B of the sample compartment P in FIG. 1 consists e.g. of a two-layer bubble film of polyethylene measuring 250×200 mm (roll width 200 mm). The absorption layer attached at a may then measure 230×170 mm (roll width 170 mm). The absorber is attached along one short end or both short ends thereof to the two-layer bubble film. It is important that the absorber, at the left-hand end in FIG. 1, does not extend too close to the left-hand end of the layer B, so that there is room for welding together the layer B and the underlying layer C, e.g. a three-layer bubble film of polyethylene, here measuring 270×200 mm (roll width 270 mm). Under these two layers, there is a layer D of polyethylene-coated kraft liner, here measuring 320×200 mm (roll width 320 mm). This kraft liner is provided with a scoring K2, in this case about 50 mm from the end of the flap. This scoring is designed to make it easier to fold the sealing flap of the sample compartment over the compartment opening (see also FIG. 3). To the left of the scoring K2, and optionally at a shorter distance than illustrated in FIG. 1 (cf. FIG. 2), the shock-absorbing layer C is welded together with the kraft liner D by the weld C close to the opening edge of the sample compartment P. In addition, the layers C and D are also welded together by welds $d_1$ and $d_2$.

The shock-absorbing layer B should always be transparent to enable an observer to perceive any changes in the appearance of the liquid-absorbing material A caused by a leaking sample. The other shock-absorbing layer C may, but need not, be transparent, translucent, or otherwise translucid. As a rule, the layer D provided with the flaps should not be transparent or translucent, at any rate if it is desired to prevent anyone from reading the contents of the referral compartment M from outside. The material of the layer D is chosen amongst suitable prior-art materials to give this layer the desired properties. For instance, the layer D may be shock-absorbing while the layer C need not.

Tests involving prototypes have proved that it is very easy to seal the two compartments of the package as well as open them separately. Opening the compartments need not be done by tearing off the strips $G_1$ or $G_2$, but may also be done by cutting or slitting them up. As a rule, this would be more difficult.

FIG. 5 illustrates an embodiment of a system for producing packages in accordance with the method of the invention. The plant operates in a one-way assembly design along a line (not designated) from the left to the right in FIG. 5. The measurement values given in the following are but examples and do not in any way restrict the invention. The system operates in such a manner that the package edge situated to the left in FIG. 1 is common to the three layers B, C and D (but the invention is not restricted thereto) as will appear further below.

Polyethylene-coated kraft paper is unwound from a roll 1 having a width of 320 mm and a tolerance of ±1 mm. The kraft paper passes a buffer roller 21, also termed dancing roller, which can move up and down if the paper is unwound from the roll in continuous manner (here by means of a pair of driving rollers 25, 25') while impulse welding at the end of the system is performed in discontinuous manner, as will be described further below. After the buffer roller 21, the web passes over an alignment roller 30 maintaining the side of the web facing the observer of FIG. 5 in a given position.

The two feed rollers 25 and 25', nipping the paper web between them, are suited for providing the web, when being fed, with scorings K2, which in this case is done 50 mm from the side facing away from an observer of FIG. 5. Another scoring KI may be provided on the side facing the observer, for the sealing flap of the referral compartment.

After positional adjustment of the edge facing the observer, the two sealing flaps are slotted. The sealing flap of the sample compartment may be given a slot 33 ±2 mm from the side at issue and having a length of 160 mm, centred over the width of the future bag in parallel with the feed direction of the kraft paper. The sealing flap of the referral compartment is given a slot, e.g. 25±2 mm from the associated edge. Also in this case, the length of the slot is 160 mm, centred over the bag width. The slots are sealed by a tear strip, e.g. 10 mm wide, just opposite the slot. The tear strips are each unwound from a roll, only the roll 40 facing the observer being shown in FIG. 5. An arm 41 is linked to the holder (not designated) of the roll. The arm 41 is acted upon by a tension spring 42 and has, at its free end, a pulley 43 over which the tear strip G is unwound and fed to a gluing device 45 which intermittently applies glue to the tear strip in such a manner that about 20 mm are left unglued and then about 180 mm are coated with glue for a package width of 200 mm. Gluing is so synchronised with the slotting devices that the glued part of the tear strips is centred on the slots of the sealing flaps, give or take a few mm. The tear strips and the paper web are joined and compressed by feed rollers 26 and 26'.

A protective layer, so-called release paper, is unwound from a roll 50 and passed over a pulley 53 which is arranged at the free end of an arm acted on by a tension spring 52 and which is linked to the holder (not designated) of the release-paper roll. The release paper is fed to a second gluing device 55 where glue is applied, whereupon the glued protective strip passes a pair of feed rollers 27, 27' and joined with the kraft liner on the side thereof facing away from the tear strip.

One release-paper roll and one gluing device 55 are provided both for the sealing flap of the referral compartment and for the sealing flap of the sample compartment. In the chosen example, the width of the sample compartment flap is equal to that of the protective strip, i.e. about 50 mm, while the second silicone-coated protective strip for the referral compartment has a width of e.g. 18 mm.

In this case, the glue is applied to the release paper strip, but it may also be applied directly to the kraft liner. For the sealing flap of the sample compartment, glue is applied, starting from maximally 1.5 mm from the edge and with a gap of about 10×170 mm just opposite to the slot, i.e. glue surrounds the slot throughout. For the sealing flap of the referral compartment on the opposite side, glue is applied, starting from about 1.5 mm from the edge and over a width of about 10 mm.

A first shock-absorbing material C is unwound from a roll 60, passed between a pair of feed rollers 28, 28' and over a dancing roller 22 as well as a plurality of guide rollers, aligned with its edge facing the observer of FIG. 5 in edge-to-edge relationship to the kraft paper D on the side facing the observer of FIG. 5 by means of a pair of alignment rollers 61, and finally joined with the kraft liner at 62. This shock-absorbing layer, which will be the intermediate layer of the package, may consist e.g. of a three-layer bubble film of polyethylene having a roll width of 270 mm±2 mm.

A second shock-absorbing material, e.g. a two-layer bubble film of polyethylene, here having a roll width of 200±2 mm, is unwound from another roll 70, passed through a pair of feed rollers 29, 29' and over a dancing roller 23, and fed, via guide rollers (not designated), to a gluing device 65 applying transverse, narrow strands of glue to the shock-absorbing material with a spacing corresponding to the roll width of the shock-absorbing material B. Then, the web is passed into a device (illustrated in more detail in FIG. 6 and also shown in FIG. 7) for cutting and applying a liquid-absorbing material A unwound from a roll 80. An arm 81 is at one end linked to the holder (not designated) of the roll. This arm is acted upon by a tension spring 82 and has, at its other end, a pulley 83. Together with the arm and the tension spring 82, the pulley 83 also serves as a dancing roller, albeit not in the vertical direction, and enables continuous tearing off when the material is discontinuously fed by a pair of feed rollers 28", 28'". The liquid-absorbing material A may have a roll width including 170±2 mm, and is cut by means of a photocell and a cutting device (not shown) into lengths of e.g. 230 mm±3 mm. The absorber sheets are placed on the bubble film layer B in such a manner that the cut edges are situated on and adjacent to, respectively, the glue strands applied in the gluing device 65, such that the front edges of the sheets are attached to the shock-absorbing material B, whereupon they pass with the web B round half the circumference of a breast roller 85, and the web B is aligned with the edge facing the observer of FIG. 5 in edge-to-edge relationship to the webs C and D by means of alignment rollers 86, and joined with the other two webs at 8%

The three webs (the kraft liner D at the bottom, the first shock-absorbing material C in between, and the shock-absorbing material B with the liquid-absorbing sheets A at the top) are then fed to an impulse-welding device 90, where they are welded together. In the welding step shown in FIG. 8, two packages at a time are always welded together in a single operation. In the top view of FIG. 8, the upper edge is the edge where the three layers are positioned edge to edge on top of one another. To the left in FIG. 8, two longitudinal welds b and c are applied. As shown in FIG. 1, the weld b is situated at the left-hand end, where only the two shock-absorbing materials B and C are interconnected, while the polyethylene-coated kraft liner D is not connected to the shock-absorbing layer C, since welding takes place in the area where the adhesive layer $L_1$ on the kraft liner D is covered by the silicone-treated release strip $F_1$ which thus does not adhere to the shock-absorbing layer C. Consequently, the sealing flap of the referral compartment M does not adhere to this layer but remains open.

The other longitudinal weld c is applied along the right-hand edge in FIG. 1 of the intermediate shock-absorbing layer C with the polyethelene-coated kraft liner. This bond may take place closer to the scoring $K_2$ than shown in FIG. 1 (cf. FIG. 2).

Further, there are provided two transverse welds both designated $d_1$, $d_2$, since one and the same weld forms e.g. the right transverse weld of one package and the left transverse weld of the other adjoining package. After welding, the web passing through the impulse-welding unit is cut in the cutting device 95 (farthest to the right in FIG. 5) along transverse marking lines indicated by dash-dot lines in FIG. 8. The longitudinal dash-dot marking line indicates the middle between the two longitudinal welds b and c. Once the web has passed the cutting device, the packages are completed. Naturally, the web may be cut in such a manner that the edges are not pointed but are given another desired, e.g. rounded, shape (cf. FIG. 2).

When a pressure is applied to the kraft liner, it should be recurrent in accordance with the chosen width of the bag, in this example every 200 mm with a tolerance of e.g. ±1 mm. The total width of the pressure should suitably be less than and centred over the intended width of the bag. Conveniently, a longitudinal gap having a width of e.g. 10 mm is left for a timing mark to be sensed by a pressure-mark transducer which in known manner controls the feed of the kraft liner, the shock-absorbing material and the liquid-absorbing material, as well as the application of glue to the tear strips, the slotting, and so forth.

When a sample (cf. FIG. 4), e.g. a perilous sample in the form of a tube closed by a plug, has been put in the sample compartment P, the latter may be sealed by removing the protective sheeting $F_2$ and folding the flap $H_2$ upwards and over the opening of the sample compartment and applying it as shown in FIG. 3. Since the adhesive layer $L_2$ extends round the slot $E_2$ and is glued to the adjoining outside of the shock-absorbing layers closest to the opening, as well as to the free area between the scoring $K_2$ and the bottom weld c of the referral compartment and also round the ends of the slot $E_2$, the sample compartment is sealed in a liquid-tight manner.

Documents relating to the sample, such as a packing slip, may then (or even before) be placed in the referral or document compartment M, which is sealed by removing the strippable protective sheeting $F_1$ and pressing the pressure-sensitive-adhesive layer $L_1$ against the second shock-absorbing sheet C. Preferably, the contour of the flap $H_1$ is identical to that of the bottom end of the sample compartment P and that of the package as a whole at the left-hand end in FIG. 1. The right-hand flap $H_2$, on the other hand, projects outwardly of the sample compartment P when not in use.

When the package according to the invention is to be opened, the removable tear strip $G_1$ or $G_2$ (depending on whether the sample compartment or the referral compartment is to be opened) is seized by one gripping flap and torn off, thereby opening the associated compartment. Suitably, the tear strip is so chosen that the structure of the kraft liner clearly shows that the strip has been torn off. After removal, the tear strip must not be sticky from any residual glue, and it should not be possible to use the tear strip for reclosing the compartment.

As a rule, the referral or document compartment is first opened by removing the tear strip $G_1$. At this stage, the sample compartment is still completely sealed, and there is thus no risk of contamination, not even if the sample R has, contrary to expectation, become untight or been damaged, giving rise to leakage in the sample compartment P. At any rate, leakage can be visually established by the absorber A changing its colour and appearance. Since the sample R is located inwardly of the absorber A, it cannot conceal any alteration of colour. By "alteration of colour" is here meant also that the colour remains the same but becomes darker or lighter owing to the leakage compared with the rest of the absorber colour. If such alteration of colour is observed, requisite protective measures against contamination can be taken well before opening the sample compartment. Since the openings of the document compartment and the sample compartment are located on diametrically opposed ends of the sample bag, the risk that one compartment is opened by mistake instead of the other is insignificant. This risk would be much greater if the openings of the two pockets or compartments were located on the same end of the package.

We claim:

1. A package, such as for perilous samples, comprising a compartmented package body having an intermediate layer and first and second layers disposed to opposite sides of said intermediate layer, respectively, with a first compartment disposed between said first layer and said intermediate layer and a second compartment disposed between said second layer and said intermediate layer, said first layer and at least one of said intermediate layer and said second layer including shock-absorbing material, and each compartment having an opening, the respective compartment openings being disposed at opposite ends of the package body, and first and second flaps disposed at the opposite ends of the package body for sealing the openings of said first and second compartments, respectively, said first and second flaps each being provided with a layer of pressure-sensitive adhesive covered by a removable protective layer and each having a slot which is covered with a tear strip which can be torn off to open the corresponding compartment.

2. A package according to claim 1, wherein a liquid absorber is arranged in said first compartment.

3. A package according to claim 2, wherein said liquid absorber has a different appearance when wet than when dry, and said first layer is made with material which permits visual observation of said liquid absorber therethrough.

4. A package according to claim 1, wherein said first layer and said intermediate layer are of liquid-tight material.

5. A package according to claim 1, wherein said first flap protrudes relative to adjacent ends of said first and second compartments and when not applied to seal said first compartment.

6. A package according to claim 1, wherein said second flap has edges which substantially coincide in contour with adjacent portions of the package.

7. A package according to claim 1, wherein the pressure-sensitive adhesive layer of said first flap completely surrounds the corresponding slot and is spaced, along a length of the corresponding slot, to each side thereof.

8. A package according to claim 1, wherein the pressure-sensitive adhesive layer of said second flap is disposed so as to flank only one side of the corresponding slot toward a free end of said second flap.

9. A package according to claim 1, wherein at least one of said intermediate layer and said second layer is opaque.

10. A package according to claim 1, wherein the layer of pressure-sensitive adhesive of said second flap is constituted by a narrow band of adhesive disposed near a free end of said second flap so as to substantially prevent unintentional adhesion to documents received in said second compartment when said second compartment is sealed by said second flap.

11. A package according to claim 1, wherein the tear strips are bonded over the corresponding slots with adhesive.

12. A method of producing a package, such as for perilous samples, having a compartmented package body including an intermediate layer and first and second layers disposed to opposite sides of the intermediate layer, respectively, with a first compartment disposed between the first layer and the intermediate layer and a second compartment disposed between the second layer and the intermediate layer and each compartment having an opening, the respective compartment openings being disposed at opposite ends of the package body, and first and second adhesive flaps disposed at the opposite ends of the package body for sealing the openings of the first and second compartments, respectively, each flap having a slot which is covered with a tear strip which can be torn off to open the corresponding compartment, said method comprising:

providing first, second, and third sheet materials for forming, respectively, the first layer, the second layer, and the intermediate layer of the package body, the first and third sheet materials being liquid-tight and shock-absorbing, with the first sheet material also having a slightly narrower dimension than the third sheet material, the second sheet material being a paper material;

slotting opposite marginal portions of the second sheet material corresponding to the first and second flaps of the package to form the slots of the flaps;

attaching material of the tear strips on one side of the second sheet material, at the marginal portions, to cover the respective slots;

applying pressure-sensitive adhesive on another side of the second sheet material, at the marginal portions;

applying removable protective sheeting to cover the pressure-sensitive adhesive applied to each of the marginal portions;

placing one side of the third sheet material on said another side of the second sheet material;

placing one side of the first sheet material on an opposite side of the third sheet material;

bonding the second and third sheet materials at portions of the third sheet material corresponding to all edges of the intermediate layer of the package body, except an edge at the end of the package body having the second flap, thereby to form the second compartment and the opening thereof; and bonding the first and third sheet materials at portions of the third sheet material corresponding to all edges of the intermediate layer of the package body, except an edge at the end of the package body having the first flap, thereby to form the first compartment and the opening thereof.

13. A method according to claim 12, wherein the first, second, and third sheet materials are unwound from rolls and superposed substantially in edge-to-edge relationship along an edge of the second sheet material corresponding to a free end the second flap.

14. A method according to claim 13, wherein the third sheet material has a roll width greater than that of the first sheet material, and wherein the second sheet material has a roll width greater than that of the third sheet material by about an amount corresponding to a width of the first flap.

15. A method according to claim 14, further comprising cross-cutting a liquid-absorbing sheet material having a width narrower than that of the package to a length less than the roll width of the first sheet material, and attaching a resulting liquid-absorbing sheet, along a cut edge thereof, adjacent to the edge of the first sheet material corresponding to an edge of the first layer at the end of the package body at which the first flap is disposed.

16. A method according to claim 12, wherein each tear strip is adhesively bonded over the corresponding slot but is provided with at least one non-bonded end portion to provide a gripping flap to facilitate tearing off of the strip.

17. A method according to claim 12, wherein the liquid-absorbing sheet material has a different appearance when wet than when dry, and wherein the first sheet material is such that the first layer of the package permits visual observation of the liquid-absorbing sheet therethrough.

18. A method according to claim 12, further comprising scoring the second sheet material adjacent the opposite marginal portions thereof.

19. A method according to claim 12, wherein said second sheet material is opaque.

20. A method according to claim 12, further comprising providing the second sheet material with one of printed opening instructions, flap and compartment designations, mailing address pre-print, and current information, with a pattern repeat corresponding to a dimension of the package.

21. A method according to claim 20, wherein the second sheet material is provided with timing mark means for controlling a timing operation.

22. A method according to claim 12, wherein at least one of the first and third sheet materials is a plastic material having entrapped gas cushions.

23. A method according to claim 12, wherein the pressure-sensitive adhesive applied to the marginal portion corresponding to the first flap completely surrounds its corresponding slot, and the pressure-sensitive adhesive applied to the marginal portion corresponding to the second flap is disposed only along one side of its corresponding slot.

24. A package, such as for perilous samples, comprising a compartmented package body having an intermediate layer and first and second layers disposed to opposite sides of said intermediate layer, respectively, said first layer being joined along edges thereof to said intermediate layer except at one of opposite ends of the package body and said second layer being joined along edges thereof to said intermediate layer except at another of said opposite ends of the package body, thereby forming a first compartment between said first layer and said intermediate layer with an opening at said one end of the package body and a second compartment between second layer and said intermediate layer with an opening at said another end of said package body, said first layer and at least one of said intermediate layer and said second layer being shock-absorbing, and first and second adhesive sealing flaps arranged on said second layer at said opposite ends of said package body for adhesively sealing said openings of said first and second compartments, respectively, each sealing flap being provided with a removable tear strip for opening the corresponding compartment.

25. A package according to claim 24, wherein each of said flaps has a slot which is covered by the corresponding tear strip.

26. A package according to claim 25, wherein the tear strips are bonded over the corresponding slots with adhesive.

27. A package according to claim 26, wherein the tear strips have non-bonded free ends forming gripping portions to facilitate tearing off of the tear strips.

28. A package according to claim 24, wherein said first flap is provided with a layer of pressure-sensitive adhesive for adhesively sealing the corresponding compartment opening, said pressure-sensitive adhesive layer being covered by a removable protective layer.

29. A package according to claim 28, wherein the pressure-sensitive adhesive layer of said first flap completely surrounds the corresponding slot and is spaced, along a length of the corresponding slot, to each side thereof.

30. A package according to claim 28, wherein a portion of the pressure-sensitive adhesive layer of said first flap is arranged to bond to a portion of said second layer disposed near said first flap, when said first flap is in a position for sealing said first compartment opening.

31. A package according to claim 30, wherein said second flap is provided with a layer of pressure-sensitive adhesive for adhesively sealing the corresponding compartment opening, said pressure-sensitive adhesive layer being covered by a removable protective layer.

32. A package according to claim 31, wherein the pressure-sensitive adhesive layer of said second flap is disposed so as to flank only one side of the corresponding slot toward a free end of said second flap.

33. A package according to claim 31, wherein the pressure-sensitive adhesive layer of said second flap is constituted by a narrow band of adhesive disposed near a free end of said second flap so as to substantially prevent unintentional adhesion to documents received in said second compartment when said second compartment is sealed by second flap.

34. A package according to claim 24, wherein a liquid absorber is arranged in said first compartment.

35. A package according to claim 34, wherein said liquid absorber has a different appearance when wet than when dry, and said first layer is made with material which permits visual observation of said liquid absorber therethrough.

36. A package according to claim 34, wherein said liquid absorber is constituted by a sheet of liquid absorbing material joined to said first layer.

37. A package according to claim 34, wherein said first outer layer and said intermediate layer are of liquid-tight material.

38. A package according to claim 24, wherein said first flap protrudes beyond ends of said first layer and said intermediate layer at said one end of the package body when not applied to seal said first compartment.

39. A package according to claim 24, wherein said second flap substantially coincides in contour with adjacent portions of the package.

40. A package according to claim 24, wherein at least one of said intermediate layer and said second layer is opaque.

41. A method of producing a package, such as for perilous samples, having a compartmented package body including an intermediate layer and first and second layers disposed to opposite sides of the intermediate layer, respectively, with a first compartment disposed between the first layer and the intermediate layer and a second compartment disposed between the second layer and the intermediate layer and each compartment having an opening, the respective compartment openings being disposed at opposite ends of the package body, and first and second adhesive flaps disposed at the opposite ends of the package body for sealing the openings of the first and second compartments, respectively, each flap having a slot which is covered with a tear strip which can be torn off to open the corresponding compartment, said method comprising:

providing first, second, and third sheet materials for forming, respectively, the first layer, the second layer, and the intermediate layer of the package body, the first sheet material and at least one of the second and third sheet materials being shock-absorbing;

providing portions corresponding to the first and second flaps of the package at opposite edges of the second sheet material;

slotting said portions to form the slots of the flaps;

attaching material of the tear strips on first sides of said portions to cover the respective slots;

providing pressure-sensitive adhesive covered with removable protective material on second sides of said portions;

placing one side of the third sheet material on one side of the second sheet material;

placing one side of the first sheet material on an opposite side of the third sheet material;

bonding the second and third sheet materials at portions of the third sheet material corresponding to all edges of the intermediate layer of the package body, except an edge at the end of the package body having the second flap, thereby to form the second compartment and the opening thereof; and bonding the first and third sheet materials at portions of the third sheet material corresponding to all edges of the intermediate layer of the package body, except an edge at the end of the package body having the first flap, thereby to form the first compartment and the opening thereof.

42. A method according to claim 41, wherein the first, second, and third sheet materials are unwound from rolls and said first and third sheet materials are superposed with said second sheet material substantially in edge-to-edge relationship with said portion corresponding to the second flap, along an edge of that portion corresponding to a free end of the second flap.

43. A method according to claim 42, wherein the third sheet material has a roll width greater than that of the first sheet material, and wherein the second sheet material has a roll width greater than that of the third sheet material by about an amount corresponding to a width of the first flap.

44. A package according to claim 41, wherein said first sheet material and said third sheet material are liquid-tight.

45. A method according to claim 42, further comprising cross-cutting a liquid-absorbing sheet material having a width narrower than that of the package to a length less than the roll width of the first sheet material, and attaching a resulting liquid-absorbing sheet, along a cut edge thereof, adjacent to an edge of the first sheet material corresponding to an edge of the first layer at the end of the package body at which the first flap is disposed.

46. A method according to claim 45, wherein the liquid-absorbing sheet material has a different appearance when wet than when dry, and wherein the first sheet material is such that the first layer of the package permits visual observation of the liquid-absorbing sheet therethrough.

47. A method according to claim 41, wherein each tear strip is adhesively bonded over the corresponding slot but provided with at least one non-bonded end portion to provide a gripping flap to facilitate tearing off of the strip.

48. A method according to claim 41, wherein the pressure-sensitive adhesive of the first flap is applied so as to completely surround the slot of the first flap, and the pressure-sensitive adhesive of the second flap is applied so as to be disposed only along one side of the slot of the second flap, toward a free end of the second flap.

* * * * *